US011441880B2

(12) United States Patent
Berman

(10) Patent No.: US 11,441,880 B2
(45) Date of Patent: Sep. 13, 2022

(54) GAS PURGED AMMUNITION CARTRIDGES

(71) Applicant: Ammo and Bullet Manufacturing, Inc., Arundel, ME (US)

(72) Inventor: Jonathan Berman, Arundel, ME (US)

( * ) Notice: Subject to any disclaimer, the term of this patent is extended or adjusted under 35 U.S.C. 154(b) by 0 days.

(21) Appl. No.: 16/995,619

(22) Filed: Aug. 17, 2020

(65) Prior Publication Data

US 2021/0072005 A1 Mar. 11, 2021

Related U.S. Application Data

(60) Provisional application No. 62/897,692, filed on Sep. 9, 2019.

(51) Int. Cl.
*F42B 33/02* (2006.01)
*F42B 5/16* (2006.01)

(52) U.S. Cl.
CPC ..... *F42B 5/16* (2013.01); *F42B 33/02* (2013.01)

(58) Field of Classification Search
CPC ..... F42B 33/02; F42B 33/0207; F42B 99/00
See application file for complete search history.

(56) References Cited

U.S. PATENT DOCUMENTS

| | | | | | |
|---|---|---|---|---|---|
| 2,068,159 | A * | 1/1937 | Von Frantzius | F42B 5/145 | 102/370 |
| 2,777,391 | A * | 1/1957 | McNally | F41B 11/62 | 102/376 |
| 4,328,632 | A * | 5/1982 | Beers | F42B 5/24 | 102/440 |
| 4,843,750 | A * | 7/1989 | Blase | F41A 29/00 | 42/95 |
| 5,107,768 | A * | 4/1992 | Langenohl | F42B 30/08 | 102/293 |
| 5,341,744 | A * | 8/1994 | Shi | F42B 5/24 | 102/430 |
| 8,302,768 | B2 * | 11/2012 | Sibley | F42B 39/22 | 89/34 |
| 2005/0056183 | A1 * | 3/2005 | Meshirer | F42B 5/025 | 102/466 |
| 2011/0174639 | A1 * | 7/2011 | Sibley | F42B 39/26 | 53/472 |

FOREIGN PATENT DOCUMENTS

| | | | | |
|---|---|---|---|---|
| WO | WO-2011090766 A1 * | 7/2011 | ..... | F42B 39/24 |

* cited by examiner

*Primary Examiner* — Jonathan C Weber
(74) *Attorney, Agent, or Firm* — Brian M. Dingman

(57) ABSTRACT

A gas purged ammunition cartridge and method. The cartridge includes a casing that is configured to contain a propellant and be coupled to a projectile, and a gas other than air introduced into the casing.

20 Claims, 2 Drawing Sheets

GAS PURGED AMMUNITION CARTRIDGES

CROSS-REFERENCE TO RELATED APPLICATION

This application claims the priority of Provisional Application 62/897,692 filed on Sep. 9, 2019.

BACKGROUND

This disclosure relates to ammunition cartridges.

Ammunition cartridges are made by assembling primers, cases, powder and projectiles or cases with an integral primer (rimfire), propellant and projectile.

SUMMARY

Featured in this disclosure are gas purged ammunition cartridges and methods by which such cartridges are manufactured. In these cartridges a gas other than air and introduced into the casing of the cartridge can be used to modify one or more chemical interactions in the cartridge. Such modified chemical interactions can be one or more of reactions between the propellant, the primer, the casing, and the projectile of the cartridge. In general, air is purged from the cartridge using an inert gas, or a gas that has some advantageous effect. Following are descriptions of exemplary, non-limiting gases and their applications. Also following are descriptions of exemplary gas purging operations and exemplary gas retention aspects.

All examples and features mentioned below can be combined in any technically possible way.

In one aspect, a gas purged ammunition cartridge includes a casing that is configured to contain a propellant and be coupled to a projectile, and a gas other than air introduced into the casing.

Some examples include one of the above and/or below features, or any combination thereof. In an example the gas is configured to either preserve one or more materials of the cartridge, inhibit chemical interaction between materials of the cartridge, assist with oxidation of the propellant, or mitigate muzzle flash. In an example the gas comprises an inert gas. In an example the gas comprises an oxidant. In an example the gas comprises fluorine. In an example the gas comprises at least one of: Argon, Nitrogen, Neon, Krypton, Xenon or any other gas which does not readily react with the propellant, the primer, the casing, and/or the projectile of the cartridge at ambient temperatures; Nitrous Oxide, Oxygen (or 30% oxygen/Noble Gas Mix), or Carbon Monoxide; and fluorine-based gases such as Sulfur Hexafluoride, Fluoromethane, and Tetrafluoroethane.

In an example the gas is introduced into the interior of the casing before the propellant is added into the casing. In an example the gas is introduced into the interior of the casing before the projectile is seated in the casing. In an example the gas is introduced into the casing during in-line manufacturing. In an example the gas is introduced via a jetting valve. In an example the manufacturing process comprises a transfer press, an indexing production line, a rotary plate press, or an ICOP press. In an example a gas tight container is used to contain the gas. In an example the gas tight chamber is retractable. In an example the cartridge is raised or lowered into a container filled with gas during production. In an example the gas is heavier than air.

In another aspect, a method of making a gas purged ammunition cartridge includes providing a casing that is configured to contain a propellant and be coupled to a projectile and introducing into the casing a gas other than air. In some examples the gas is configured to either preserve one or more materials of the cartridge, inhibit chemical interaction between materials of the cartridge, assist with oxidation of the propellant, or mitigate muzzle flash. The gas may be an inert gas, an oxidant, or it may include fluorine.

DETAILED DESCRIPTION

Figure 1A:
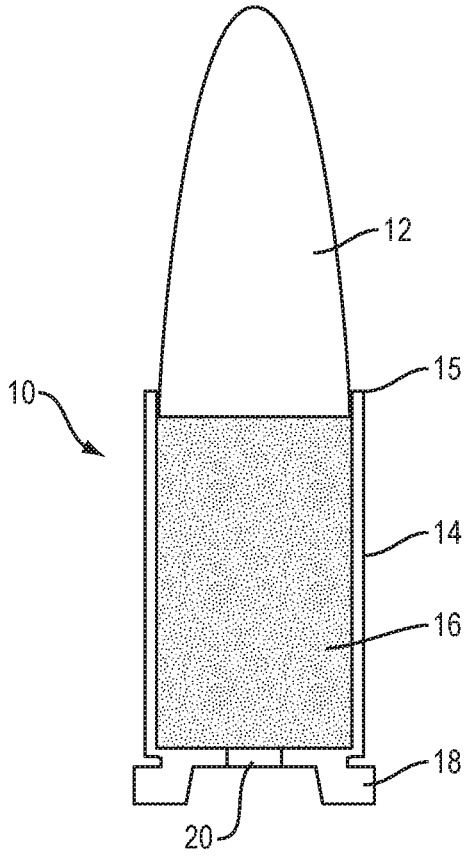
FIG. 1A is a cross-sectional schematic view of an ammunition cartridge for a pistol and FIG. 1B is a cross-sectional schematic view of an ammunition cartridge for a rifle.
Figure 1B:
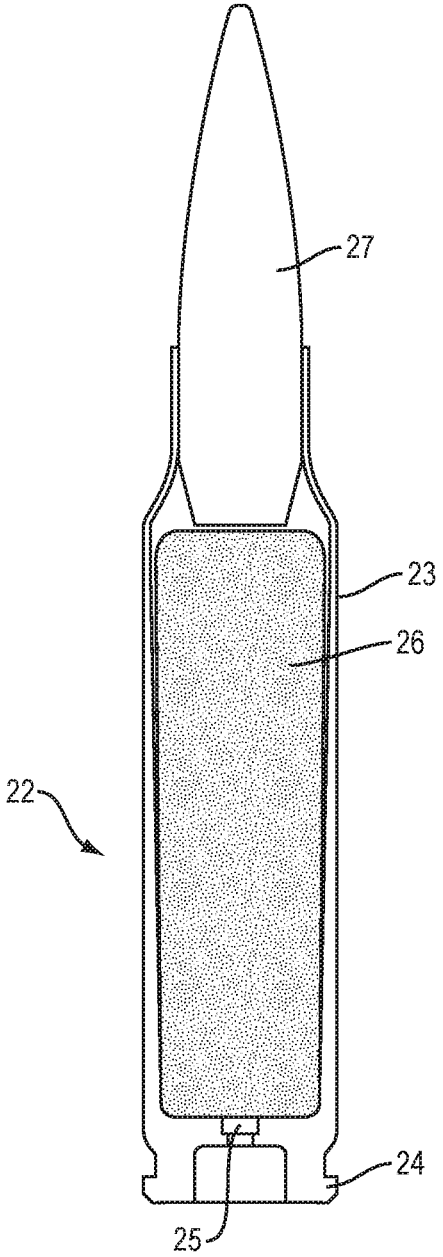

A cartridge 10 is shown in FIG. 1A. Cartridge 10 is configured as a pistol round and includes casing 14 that holds projectile 12 near top end 15 of casing 14. Propellant 16 is located in a cavity in casing 14, underneath projectile 12. Casing 14 includes base region 18 that defines a cavity 20 for a primer. Cartridge 22 FIG. 1B is configured as a rifle round and is generally similar to the pistol round but has a bottle-neck case and a more elongated projectile. Cartridge 22 includes casing 23 that holds projectile 27 and contains propellant 26. Casing 23 has base region 24 that defines a cavity 25 for the primer.

In the present disclosure, a gas is introduced into the interior of the casing before the propellant is added into the casing and/or the gas is introduced after the propellant but before the projectile is seated in the casing. More detail is provided below.

Gases and their applications. In one example, where the aim is preservation of the cartridge (i.e., increase its shelf life), and/or to inhibit or prevent chemical breakdown in the cartridge, an inert gas such as argon, nitrogen, neon, krypton, xenon or any other inert gas, or a gas that does not readily react with the propellant, the primer, the casing, and/or the projectile of the cartridge at ambient temperatures is introduced into the empty casing 14, or into casing 14 after the propellant 16 but before projectile 12 is added.

In a second example the aim is to boost the performance of the propellant. In this example the gas promotes oxidation of the propellant when the gun is fired. Such gases can include but are not limited to nitrous oxide, oxygen, a 30% or more oxygen/noble gas mixture), carbon monoxide, and other gases that include oxygen or are known to assist with rapid and complete oxidation of the propellant.

In another example the aim is to mitigate muzzle flash. In this case the purge gas can be a fluorine-based gas, such as sulfur hexafluoride, fluoromethane, or tetrafluoroethane.

Other purge gases are contemplated, and can be used to achieve the aims described herein, or other aims.

The cartridges can be purged with these gases using any appropriate method. Non-limiting examples of such methods include but are not limited to the following.

Figure 2:
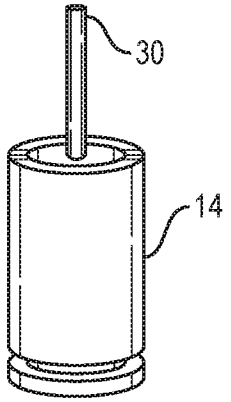
FIG. 2 illustrates a casing being purged with a gas.
Figure 3:
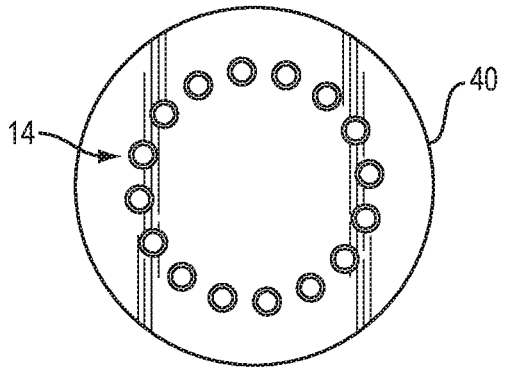
FIG. 3 is a top view of a rotary press that can be used in the gas purging method.
Figure 4:
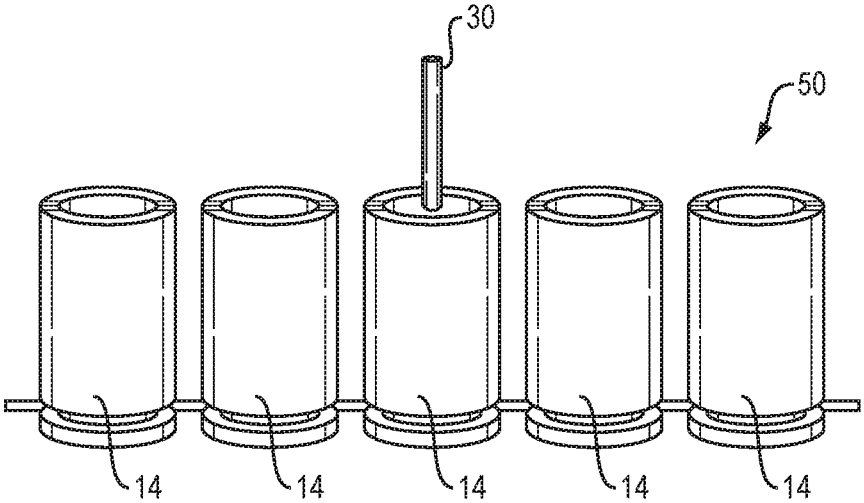
FIG. 4 illustrates an in-line transfer press that can be used in the gas purging method.

Gases may be introduced into the casing 14 during in-line manufacturing via a jetting valve into a gas deliver tube 30, FIG. 2. This type of application is best suited for process which starts and stops frequently. Examples include: rotary plate presses (e.g., rotary plate 40, FIG. 3, that carries casings 14), transfer presses, indexing production lines (e.g., in-line transfer press 50, FIG. 4, where cartridges 14 are moved to and past gas delivery tube 30), individual cam-operated plunger (ICOP) presses, and most modern methods of production.

Figure 5:
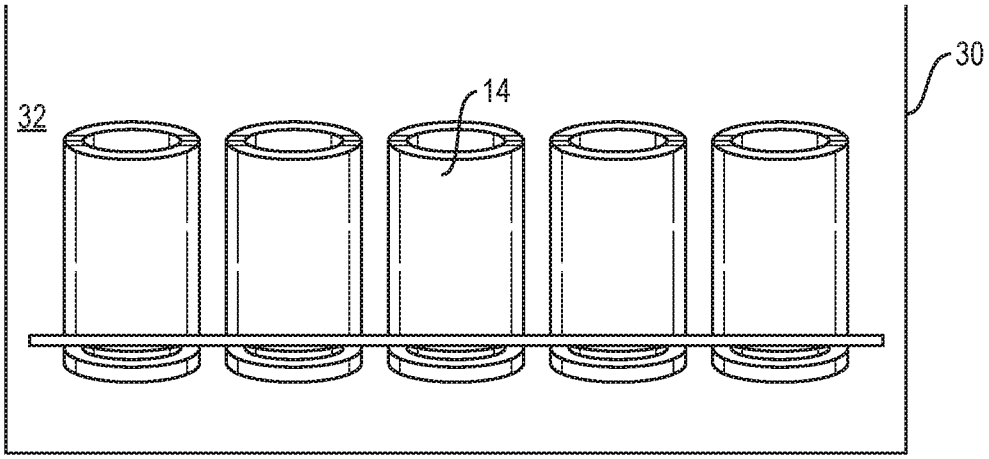
FIG. 5 schematically illustrates a container-based gas purging method.

In another example a gas tight container 30 such as a glove box may be used. See FIG. 5, where container 30 contains heavier than air gas 32. This is particularly applicable for ammunition manufactured in fixtures or plates 36 that carry casings 14 (or cartridges), where fixture 36 is lowered into container 30 so that gas 32 can displace the air in the casings. Or a retractable gas tight chamber may be used for producing ammunition inline. Or the cartridges can be raised or lowered into a container filled with gas during production. In another alternative (not shown) the container containing the gas can be lowered over the casings or cartridges and then raised.

To ensure that the introduced gas does not escape, a gas tight seal is required. Almost all ammunition is sealed via a metal to metal friction fit or through crimping the primer and projectile to form a seal. These methods may not be sufficient to create a gas-tight seal, but may be sufficient for retention of larger gas molecules. Better sealing may also be performed via a method in which a "tar" or any other viscous, gasket-forming material (including two part sealant and aerobic sealants) is applied to the case mouth 15 and/or the primer pocket 20 prior to assembly. Cartridges may alternatively be sealed with a lacquer type coating where a lacquer or any other coating/paint/polymer is applied to the outer areas where the primer and projectiles meet the casing. Sealant of this type may also be applied to the inner areas of where the projectile and primer are inserted into the casing. An alternative sealing method is by use of an adhesive (e.g., an ultraviolet (UV) cured or heat cured or aerobic wicking adhesive) that is dispensed on the primer pocket-primer seam and projectile—case mouth seam. This type of wicking sealant can be applied to the loaded cartridge and drawn via capillary action.

A number of implementations have been described. Nevertheless, it will be understood that additional modifications may be made without departing from the scope of the inventive concepts described herein, and, accordingly, other examples are within the scope of the following claims.

What is claimed is:

1. A gas purged ammunition cartridge, comprising:

a casing that contains a propellant in an interior of the casing and also carries a primer, wherein the casing defines an open mouth at an end of the casing;

a projectile that is seated in the open mouth of the casing and is configured to be propelled away from the casing when the propellant in the casing is oxidized; and a gas other than air in the interior of the casing along with the propellant;

wherein a seam where the casing and projectile meet is sealed, to inhibit escape of the gas from the cartridge through the seam.

2. The gas purged ammunition cartridge of claim 1, wherein the gas is configured to either preserve one or more materials of the cartridge, inhibit chemical interaction between materials of the cartridge, assist with oxidation of the propellant, or mitigate muzzle flash.

3. The gas purged ammunition cartridge of claim 1, wherein the gas comprises an inert gas.

4. The gas purged ammunition cartridge of claim 1, wherein the gas comprises an oxidant.

5. The gas purged ammunition cartridge of claim 1, wherein the gas comprises fluorine.

6. The gas purged ammunition cartridge of claim 1, wherein the gas comprises at least one of: argon, Nitrogen, neon, krypton, xenon or any other gas which does not readily react with the propellant, the primer, the casing, and/or the projectile of the cartridge at ambient temperatures; nitrous oxide, oxygen, or carbon monoxide; and fluorine-based gases such as sulfur hexafluoride, fluoromethane, and tetrafluoroethane.

7. A method of making a gas purged ammunition cartridge, comprising:

providing a casing that contains a propellant in an interior of the casing and also carries a primer, wherein the casing defines an open mouth at an end of the casing;

seating a projectile in the open mouth of the casing, wherein the projectile is configured to be propelled away from the casing when the propellant in the casing is oxidized;

introducing into the interior of the casing along with the propellant a gas other than air; and sealing a seam where the casing and projectile meet, to inhibit escape of the gas from the cartridge through the seam.

8. The method of claim 7, wherein the gas is configured to either preserve one or more materials of the cartridge, inhibit chemical interaction between materials of the cartridge, assist with oxidation of the propellant, or mitigate muzzle flash.

9. The method of claim 7, wherein the gas comprises an inert gas.

10. The method of claim 7, wherein the gas comprises an oxidant.

11. The method of claim 7, wherein the gas comprises fluorine.

12. The method of claim 7, wherein the gas is introduced into the interior of the casing before or after the propellant is added into the casing.

13. The method of claim 7, wherein the gas is introduced into the interior of the casing before the projectile is seated in the casing.

14. The method of claim 7, wherein the gas is introduced into the casing during in-line manufacturing.

15. The method of claim 14, wherein the gas is introduced via a jetting valve.

16. The method of claim 14, wherein the manufacturing process comprises a transfer press, an indexing production line, a rotary plate press, or an ICOP press.

17. The method of claim 7, wherein a gas tight container is used to contain the gas.

18. The method of claim 17, wherein the gas tight chamber is retractable.

19. The method of claim 7, wherein the cartridge is raised or lowered into a container filled with gas during production.

20. The method of claim 19, wherein the gas is heavier than air.

* * * * *